US006789582B2

(12) United States Patent
Mancusi

(10) Patent No.: US 6,789,582 B2
(45) Date of Patent: Sep. 14, 2004

(54) CASTING APPARATUS FOR THE PRODUCTION OF METAL CASTINGS BY "LOST-FOAM" TECHNOLOGY

(75) Inventor: Andrea Mancusi, Carmagnola (IT)

(73) Assignee: Teksid Aluminum S.r.l., Turin (IT)

( * ) Notice: Subject to any disclaimer, the term of this patent is extended or adjusted under 35 U.S.C. 154(b) by 0 days.

(21) Appl. No.: 10/472,933

(22) PCT Filed: Mar. 25, 2002

(86) PCT No.: PCT/EP02/03324

§ 371 (c)(1),
(2), (4) Date: Mar. 26, 2004

(87) PCT Pub. No.: WO02/076657

PCT Pub. Date: Oct. 3, 2002

(65) Prior Publication Data

US 2004/0149347 A1 Aug. 5, 2004

(30) Foreign Application Priority Data

Mar. 27, 2001 (IT) ..... TO2001A0287

(51) Int. Cl.[7] ..... B65B 1/04
(52) U.S. Cl. ..... 141/65; 164/34; 164/119
(58) Field of Search ..... 141/59, 65; 164/34, 164/119, 120, 35

(56) References Cited

U.S. PATENT DOCUMENTS 4,787,434 A 11/1988 Clearly et al.
5,058,653 A 10/1991 Garat
5,062,470 A * 11/1991 Rikker ..... 164/457
5,954,113 A * 9/1999 Buchborn ..... 164/61
6,499,529 B1 * 12/2002 Farkas ..... 164/114

FOREIGN PATENT DOCUMENTS

FR 2 647 380 A 11/1990

OTHER PUBLICATIONS

Database WPI, Section Ch, Week 198751 Derwent Publications Ltd., London, GB; Class M22, AN 1987–361193, XP002215762.

* cited by examiner

*Primary Examiner*—Steven O. Douglas
(74) *Attorney, Agent, or Firm*—Sughrue Mion, PLLC

(57) ABSTRACT

Apparatus for casting molten metal for the production of metal castings by "lost-foam" technology, comprises: a first container (15) of molten metal, a second container (1) having an upper mouth and containing a bath of granular material (2), immersed in which is a pattern (3, 3*a*) made of expanded material which can evaporate when contacted by the molten metal, and filling means (14) for supplying the molten metal from the first container (15) to the pattern (3, 3*a*) in the second container (1), and means for applying a partial vacuum to the second container (1), the means comprising a removable cover (7) which can seal the mouth of the second container (1) in a leaktight manner and which has a first opening (9) with which vacuum-generating means (10, 11) are associated and a second opening (13) with which the filling means (14) are associated in a leaktight manner so that, when the cover (7) is fitted on the second container (1) in a leaktight manner and the vacuum-generating means (10, 11) are activated, the liquid metal is transferred from the first container (15) to the pattern (3, 3*a*).

4 Claims, 2 Drawing Sheets

CASTING APPARATUS FOR THE PRODUCTION OF METAL CASTINGS BY "LOST-FOAM" TECHNOLOGY

This is a National Stage Entry of Application No. PCT/EP02/03324 filed Mar. 25, 2002; the disclosure of which is incorporated herein by reference.

BACKGROUND OF THE INVENTION

The present invention relates to apparatus for casting molten metal for the production of metal castings by so-called "lost-foam" technology.

SUMMARY OF THE INVENTION

In particular, the invention relates to apparatus of the type comprising:

a first container of molten metal, a second container having an upper mouth and containing a bath of granular material, immersed in which is a pattern made of expanded material which can evaporate when contacted by the molten metal, and filling means for supplying the molten metal from the first container to the pattern in the second container.

The primary object of the invention is to provide apparatus which enables the liquid metal to be transferred from the molten-metal container to the pattern without time limitations and without limitations of the amount of metal required to fill the pattern or form.

For this purpose, a subject of the invention is apparatus of the type mentioned above which is characterized in that it comprises:

means for applying a partial vacuum to the second container, the means comprising a removable cover which can seal the mouth of the second container in a leaktight manner and which has a first opening with which vacuum-generating means ere associated and a second opening with which the filling means are associated in a leaktight manner so that, when the cover is fitted on the second container in a leaktight manner and the vacuum-generating means are activated, the liquid metal is transferred from the first container to the pattern.

A second subject of the invention is a method of casting under reduced pressure, which uses the above-mentioned apparatus.

Further advantages and characteristics of the apparatus and of the method according to the invention will become clear from the following detailed description, given with reference to the appended drawings, in which:

DETAILED DESCRIPTION OF THE INVENTION

Figure 1:
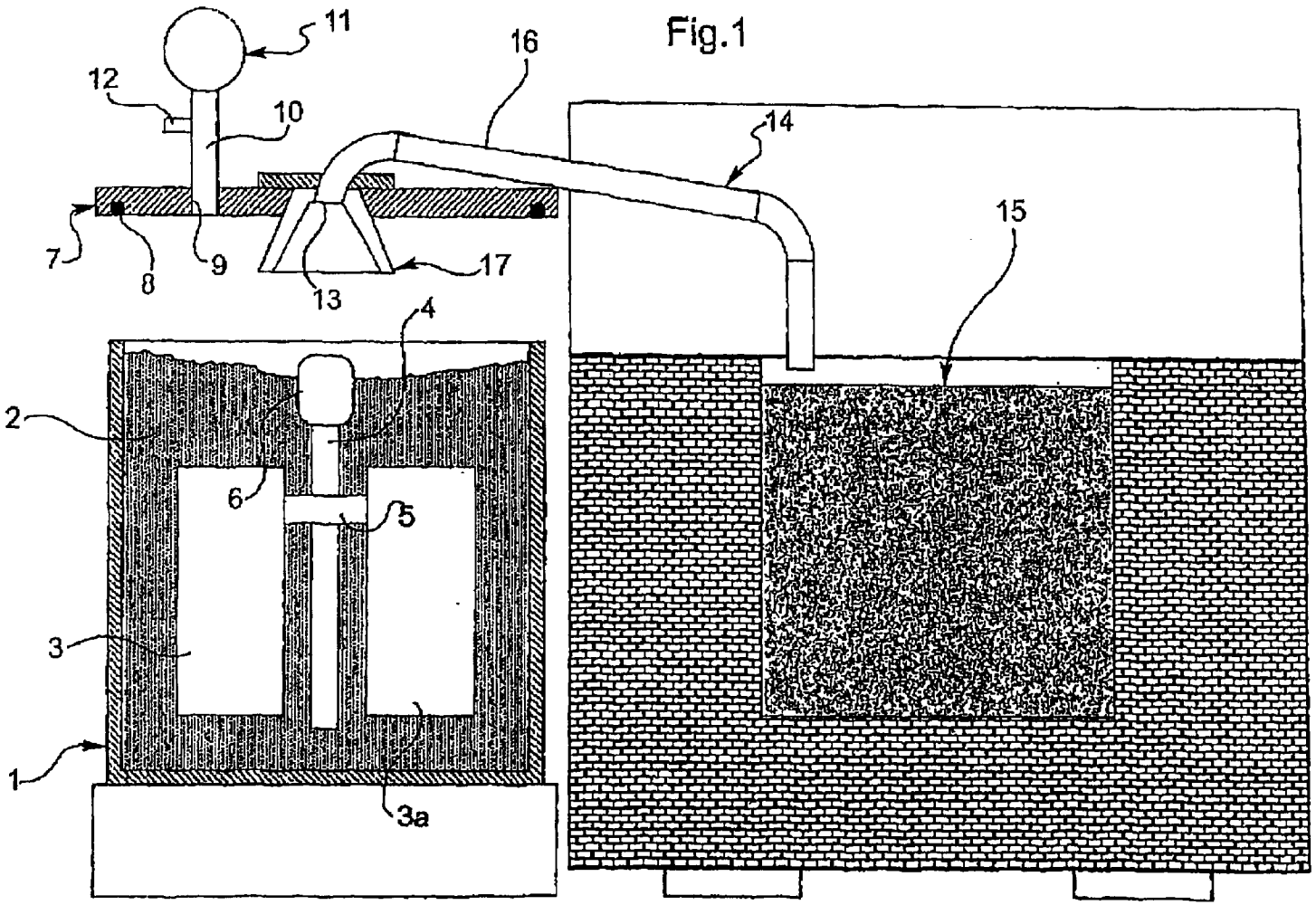
FIG. 1 is a schematic view of apparatus according to the invention.

In the drawings, a casting container, indicated 1 and generally made of metal, has an open upper mouth which, according to the "lost-foam" technique, which is known per se, comprises a bath of foundry sand 2 in which a pattern 3 of the casting to be cast, typically made of expanded polystyrene, is immersed.

Generally, two or more patterns 3, 3*a* are connected to one another in a cluster by means of branches 4 and 5 which are also made of expanded polystyrene and which, during casting, act as ducts for supplying the molten metal to the patterns defining the castings to be produced.

In the view of FIG. 1, the cluster comprises a main branch 4 with a head 6 which projects from the sand bath and in contact with which the molten metal is supplied.

The pattern or cluster of pattern and the respective metal-supply branch or branches are preferably coated with a coating for rendering the surface of the expanded material permeable to gases.

A cover, indicated 7, provided with a sealing ring 8, can engage the upper mouth of the container 1 in a leaktight manner in order to isolate the container from the outside atmosphere.

The cover 7 has first opening 9 associated with a suction duct 10 communicating with a vacuum pump 11 and with a reduced-pressure valve 12.

The cover 7 also comprises a second opening 13 with which filling means 14 are associated in a leaktight manner in order to supply the molten metal from a holding furnace 15 to the casting container 1. The filling means comprise a siphon-like duct 16 that opens in a bell 17 which is preferably covered with ceramic material and is associated with the cover 7 in a leaktight manner.

Figure 2:
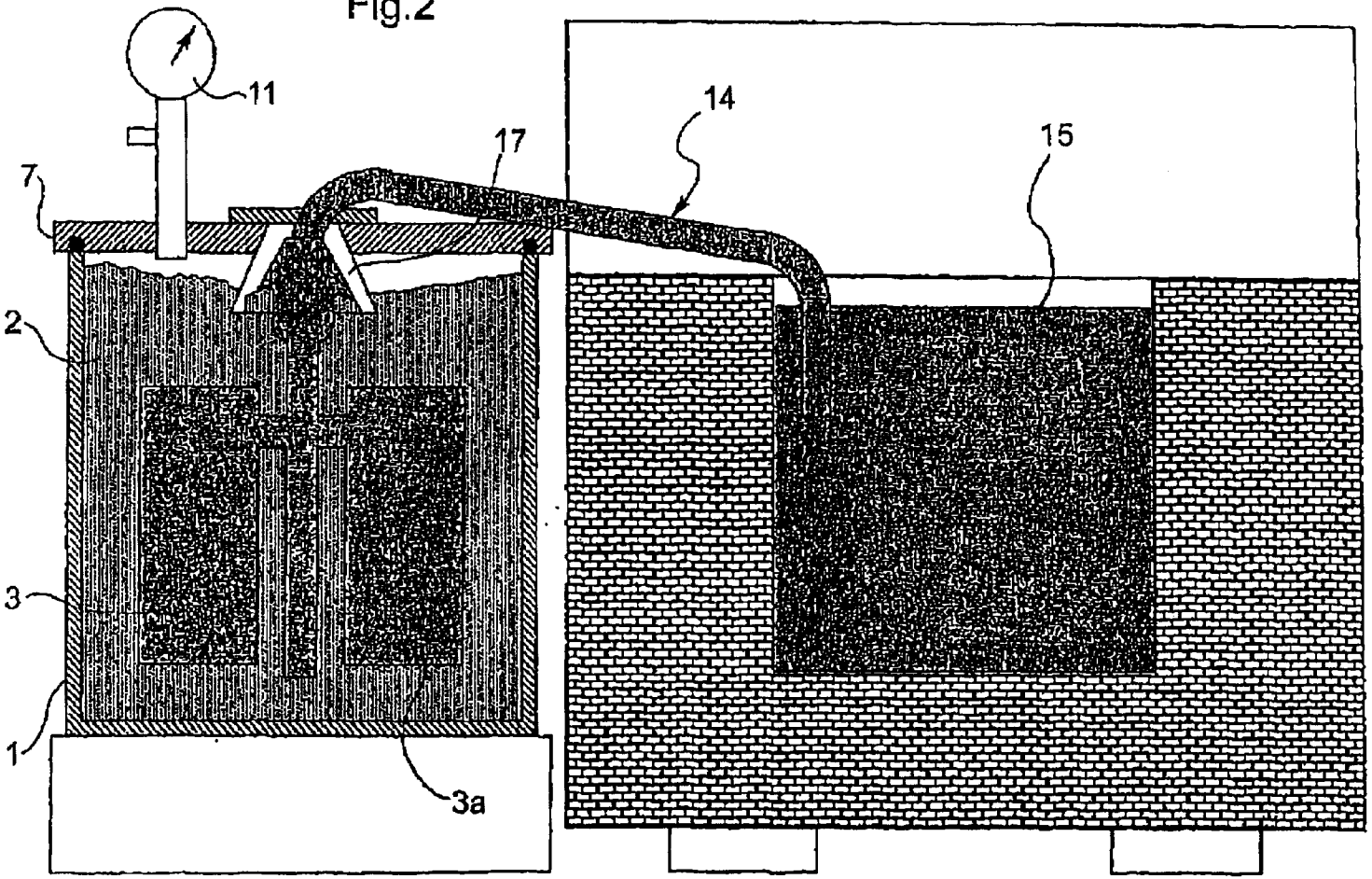
FIG. 2 is a schematic view of the apparatus in an operative stage following that of FIG. 1.

In order to perform the casting step shown in FIG. 2, the cover 7 is placed on the mouth of the container 1 so as to sea the mouth of the container in a leaktight manner and the duct 14 is immersed in the bath of molten metal in the holding furnace 15. The bell 17 will sink into the containing sand 2, enclosing the head 6 of the polystyrene cluster.

Filling starts with the generation of the partial vacuum by means of the pump 11; during the initial stages of the process, the generation of the partial vacuum—by evacuation of the air contained in the spaces between the granules of foundry sand—brings about compaction of the sand which improves the quality of the casting. Further vacuum generation then creates the reduced pressure necessary for the metal to flow from the holding furnace 15 into the pattern container 1.

Upon completion of the filling, the pumping system 11 is deactivated and the reduced-pressure valve 12 is opened in order to re-establish ambient pressure conditions in the container. At this point, the cover 7 is removed from the container, possibly by handling means provided specifically for that purpose, to permit withdrawal of the casting or cluster formed.

The casting apparatus according to the invention and the respective casting method which uses it enable considerable advantages to be achieved, amongst which, in particular, are:

a large degree of operative flexibility which permits the casting of shaped castings of any size, since it is possible to supply any desired quantity of molten metal held in the withdrawal furnace, without the need for specific metering, heat losses in the course of the transfer are low and cycle times are reduced, by virtue of the lower thermal losses, it is possible to reduce the supply temperature of the molten metal, thus achieving a reduction in the porosity of the casting, as well as energy saving, and improved casting quality is also achieved by virtue of the rapid suction of the combustion gases and by virtue of the reduction in the oxidation of the metal alloy resulting from the preliminary removal of the air incorporated in the foundry sand.

Naturally, the principle of the invention remaining the same, the forms of embodiment and details of construction may be varied widely with respect to those described and illustrated by way of non-limiting example, without departing from the scope of the appended claims.

What is claimed is:

1. Apparatus for casting molten metal for the production of metal castings by "lost-foam" technology, comprising:

a first container (15) of molten metal, a second container (1) having an upper mouth and containing a bath of granular material (2), immersed in which is a pattern **(3, 3*a*) made of expanded material which can evaporate when contacted by the molten metal, and filling means (14) for supplying the molten metal from the first container (15) to the pattern (3, 3*a*) in the second container (1)**, characterized in that it comprises:

means for applying a partial vacuum to the second container (1), the means comprising a removable cover (7) which can seal the mouth of the second container (1) in a leaktight manner and which has a first opening (9) with which vacuum-generating means (10, 11) are associated and a second opening (13) with which the filling means (14) are sealingly associated so that, when the cover (7) is fitted on the second container (1) in a leaktight manner and the vacuum-generating means (10, 11) are activated, the liquid metal is transferred from the first container (15) to the pattern **(3, 3*a*)**.

2. Casting apparatus according to claim 1, characterized in that the filling means (14) comprise a siphon-like duct (16) which opens in a bell (17) sealingly associated with the cover (7).

3. Casting apparatus according to claim 2, characterized in that the bell (17) is arranged to surround a head end (6) of a branch (4) of expanded material connected to the pattern **(3, 3*a*)** of the casting to be cast.

4. A method of casting molten metal for the production of metal castings by "lost-foam" technology with the use of casting apparatus according to claim 1.

* * * * *